US006181081B1

(12) United States Patent
Hirschmann et al.

(10) Patent No.: US 6,181,081 B1
(45) Date of Patent: Jan. 30, 2001

(54) IGNITION DEVICE FOR A DISCHARGE LAMP AND METHOD FOR IGNITING A DISCHARGE LAMP

(75) Inventors: Guenther Hirschmann, Munich; Juergen Becker, Berlin; Gerhard Behr, Altheim; Christian Wittig, Munich; Peter Helbig, Sontheim, all of (DE)

(73) Assignee: Patent-Treuhand-Gesellschaft fuer elektrische Gluehlampen mbH, Munich (DE)

( * ) Notice: Under 35 U.S.C. 154(b), the term of this patent shall be extended for 0 days.

(21) Appl. No.: 09/230,098

(22) PCT Filed: May 8, 1998

(86) PCT No.: PCT/DE98/01272

§ 371 Date: Jan. 20, 1999

§ 102(e) Date: Jan. 20, 1999

(87) PCT Pub. No.: WO98/53647

PCT Pub. Date: Nov. 26, 1998

(30) Foreign Application Priority Data

May 21, 1997 (DE) ..... 197 21 149
Jan. 28, 1998 (DE) ..... 198 03 139

(51) Int. Cl.[7] ..... H05B 37/02
(52) U.S. Cl. ..... 315/289; 315/276; 315/219
(58) Field of Search ..... 315/289, 290, 315/244, 209 CD, 276, 219, 291, 241 R

(56) References Cited

U.S. PATENT DOCUMENTS 5,444,334 * 8/1995 Speaker et al. ..... 315/227 R
5,892,332 * 4/1999 Drews et al. ..... 315/289
5,894,202 * 4/1999 Betz et al. ..... 315/289

FOREIGN PATENT DOCUMENTS 4227427 2/1994 (DE) .
4333886 4/1995 (DE) .
0515958 12/1992 (EP) .
9704624 2/1997 (WO) .

OTHER PUBLICATIONS

Patent Abstracts of Japan, vol. 018, No. 545 (E–1617), Oct. 18, 1994.

* cited by examiner

*Primary Examiner*—Don Wong
*Assistant Examiner*—Wilson Lee
(74) *Attorney, Agent, or Firm*—William E. Meyer

(57) ABSTRACT

The invention relates to a pulse starting device and a starting method for a discharge lamp, in particular a high-pressure discharge lamp for a motor vehicle headlamp. The starting device has a transformer which has either two primary windings which are connected in parallel and are both coupled inductively to the at least one secondary winding, or instead has a primary winding which consists of a wide metal strip and is wound, separated by an electric insulation, over the at least one secondary winding. The starting device according to the invention has a compact design which permits the complete starting device to be accommodated in the lamp cap.

20 Claims, 3 Drawing Sheets

IGNITION DEVICE FOR A DISCHARGE LAMP AND METHOD FOR IGNITING A DISCHARGE LAMP

Figure 1:
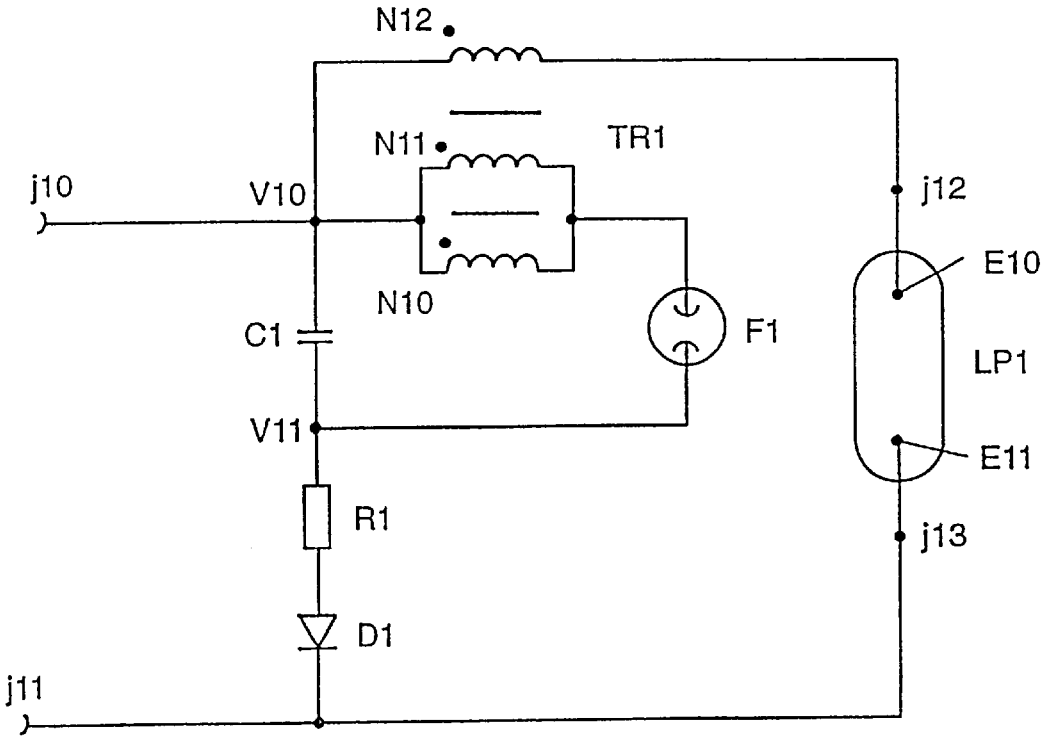

The invention relates to a starting device for a discharge lamp in accordance with the preamble of Patent Claim 1 or 12, and to a method for starting a discharge lamp.

I. TECHNICAL FIELD

The invention relates in particular to a starting device for a high-pressure discharge lamp, for example a low-wattage halogen metal vapour high-pressure discharge lamp for a motor vehicle headlamp. The high-pressure discharge lamp has a discharge vessel which is sealed in a gastight fashion. Projecting into the discharge space are two gas discharge electrodes which are connected in an electrically conducting fashion to external supply leads. During operation of the discharge lamp, a light-emitting discharge arc is formed between its gas discharge electrodes. To operate the lamp, an operating unit is required which supplies the discharge lamp with electric power and limits the discharging current via the discharge arc. The operating unit also comprises a starting device for the discharge lamp which initiates the gas discharge. In order to start the gas discharge in a high-pressure discharge lamp, a starting voltage of a few kilovolts is required for a cold lamp, while to restart the same lamp when hot—that is to say to start it in the still hot state—a starting voltage of more than 20 kV can be required. After starting of the gas discharge lamp has been performed, the operating voltage of the high-pressure discharge lamp drops, that is to say the voltage drop over the discharge path which is required to maintain the discharge arc, to only approximately 80 V to 100 V. The starting device can be constructed, for example, as a pulse starting unit which applies unipolar high-voltage pulses to one of the two gas discharge electrodes of the high-pressure discharge lamp during the starting phase.

II. PRIOR ART

A starting device corresponding to the preamble of Patent Claim 1 is disclosed in the PCT application with the international publication number WO 97/04624. This starting device is a pulse starting device for a high-pressure discharge lamp. The pulse starting device has a starting transformer with a primary winding and a secondary winding, a starting capacitor, a resistor element via which the starting capacitor is charged, and an automatic switch. One terminal of the secondary winding is connected to one of the gas discharge electrodes of the high-pressure discharge lamp, while its other terminal is connected to the voltage input of the starting device. The primary winding of the starting transformer and the switching path of the automatic switch are arranged in such a way that the discharging current of the starting capacitor flows through them.

Since the starting voltage required to restart the high-pressure discharge lamp when hot is substantially higher than the voltage present at the voltage input of the starting device, the starting transformer must have an appropriately high transformation ratio. As a consequence of the high transformation ratio of the starting transformer, the known and commercially available starting devices have a high space requirement because of the large volume of the starting transformer. Consequently, in the case of low-wattage halogen metal vapour high-pressure discharge lamps which are provided for use in motor vehicle headlamps, it is not possible to accommodate the starting device for these lamps in the lamp cap.

III. DESCRIPTION OF THE INVENTION

It is the object of the invention to provide an improved starting device for a discharge lamp, and an improved method for starting a discharge lamp. In particular, the starting device is intended to have as compact a design as possible, so that it can still be accommodated in the lamp cap even in the case of the low-wattage halogen metal vapour high-pressure discharge lamps which are used in motor vehicle headlamps and are of very small design.

This object is achieved according to the invention by means of the characterizing features of Patent Claim 1 or 13. Particularly advantageous embodiments of the invention are described in the subclaims.

According to the invention, the starting device according to the invention has a transformer which has a parallel circuit, comprising at least two primary windings, and at least one secondary winding, the parallel circuit of the primary windings being inductively coupled to the at least one secondary winding. For a given transformation ratio of the transformer, this measure permits the number of turns per unit length on the secondary side of the transformer to be substantially reduced without the inductive coupling between the primary and secondary sides being impaired by the low number of turns per unit length of the primary windings. The induced voltage available on the secondary side does not change if the transmission ratio is preserved.

The primary windings have advantageously respectively at most two turns. As a result, there is also a reduction in the number of turns per unit length of the at least one secondary winding in accordance with the desired transformation ratio. It has emerged that, for example, a transformer with two primary windings, which are connected in parallel and have two turns in each case, has just as good inductive coupling between the primary and secondary sides as a transformer with only one primary winding which has four turns. However, for a prescribed transformation ratio of the transformer, only half as many turns are required for the case of the two primary windings which are connected in parallel and respectively have two turns on the secondary side as for the case of the one primary winding with four turns. In order to improve still further the inductive coupling between the primary and secondary sides of the transformer, the primary windings connected in parallel can advantageously consist in each case of a copper strip.

The reduction of the number of turns per unit length on the secondary side permits a compact design of the transformer and of the entire starting device, with the result that all the subassemblies of the starting device, including the transformer, can be accommodated in the lamp cap. The expensive electric connections, provided with insulation which is proof against high voltage, between the lamp holder and the starting unit are thereby eliminated. The high-voltage pulses for starting the gas discharge are then generated inside the lamp cap and are therefore no longer accessible from outside.

It has proved advantageous to use a transformer with a ferrite core and a coil former which has at least one chamber for the transformer windings. To avoid electric breakdowns and to prevent eddy currents in the ferrite body, the ferrite core advantageously consists of a high-resistance material, with the result that the ferrite core has an electric resistance of more than 1 MΩ. It is advantageous to use E cores or cylindrical cores, such as cylinder cores, tubular cores or threaded cores, for example, as ferrite body.

The starting device according to the invention comprises a capacitor, a resistor element, an automatic switch and a transformer with at least two primary windings connected in parallel and at least one secondary winding. The components of the starting device are arranged and interconnected in such a way that the capacitor discharges abruptly for starting the gas discharge in the lamp, the discharging current of the capacitor flowing via the parallel circuit of the primary windings and via the switching path of the automatic switch, with the result that the voltage pulses induced in the at least one secondary winding are applied to one of the gas discharge electrodes of the lamp.

In a first preferred exemplary embodiment of the invention, the starting device is constructed as an asymmetrical pulse starting device which applies unipolar starting voltage pulses to only one of the lamp electrodes. In this starting device, the transformer has only one secondary winding, which is connected to a terminal of the starting voltage output for the discharge lamp.

In the second, particularly preferred exemplary embodiment of the invention, the starting device is designed as a symmetrical pulse starting device which simultaneously applies unipolar starting voltage pulses of opposite polarity to the two gas discharge electrodes of the lamp. By contrast with the asymmetric pulse starting device, this mode of operation has the advantage of lower line losses and lesser demands on the electric insulation of the lamp parts conducting high voltage. The particularly preferred second exemplary embodiment of the pulse starting device has a transformer with two primary windings which are connected in parallel and through both of which, during the starting phase of the lamp, there flows the discharge current of the capacitor of the starting device, which capacitor discharges in surges via the switching path of the automatic switch, and two secondary windings, which are both inductively coupled to the parallel circuit of the primary windings. In each case, the two secondary windings are connected via a terminal of the starting voltage output to a gas discharge electrode of the lamp and are arranged in such a way that unipolar high-voltage pulses of opposite polarity are induced in the two secondary windings by the abovenamed discharging current.

Another solution for the set problem of the invention is described in the characterizing part of Patent Claim 13 and the third exemplary embodiment of the invention.

In the third exemplary embodiment of the pulse starting device, the transformer belonging to the starting device has a primary winding with at most two turns, which consists according to the invention of a wide metal strip which encloses the at least one secondary winding and advantageously also encloses the ferrite body of the transformer. For a given transformation ratio of the transformer, this measure permits the number of turns per unit length on the secondary side of the transformer to be reduced considerably without impairing the inductive coupling between the primary and secondary sides by the low number of turns per unit length of the primary winding. It has proved to be advantageous to use a transformer with a ferrite core and a coil former which has at least one chamber for the at least one secondary winding. To avoid electric breakdowns and to prevent eddy currents in the ferrite body, the ferrite core advantageously consists of a material which has an electric resistance of more than 1 MΩ. E cores or cylindrical cores, such as cylinder cores, tubular cores or threaded cores, for example, are advantageously used as ferrite body.

IV. DESCRIPTION OF THE PREFERRED EXEMPLARY EMBODIMENTS

Figure 2:
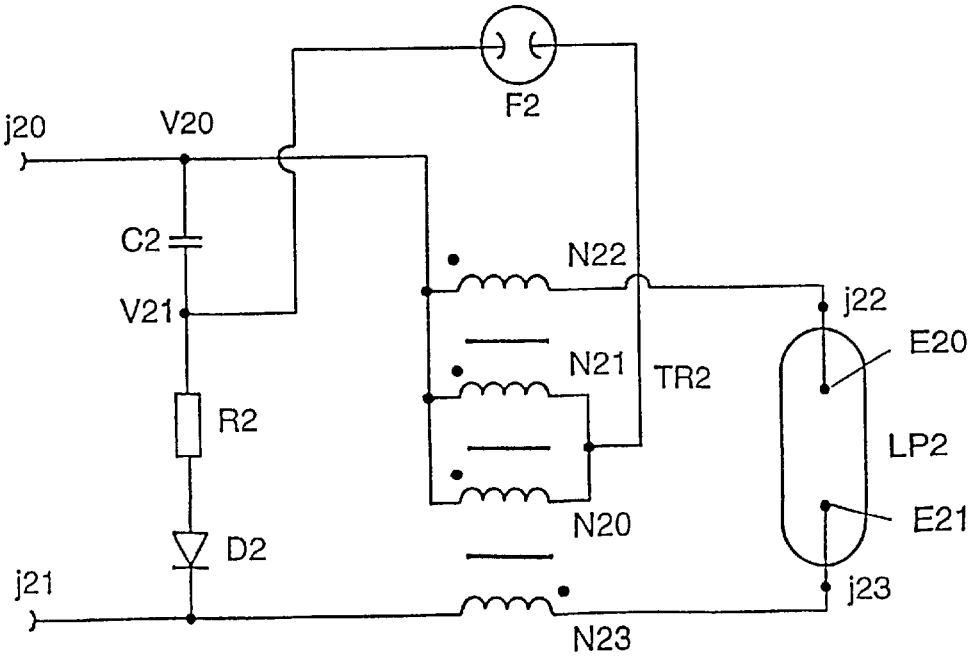
Figure 3:
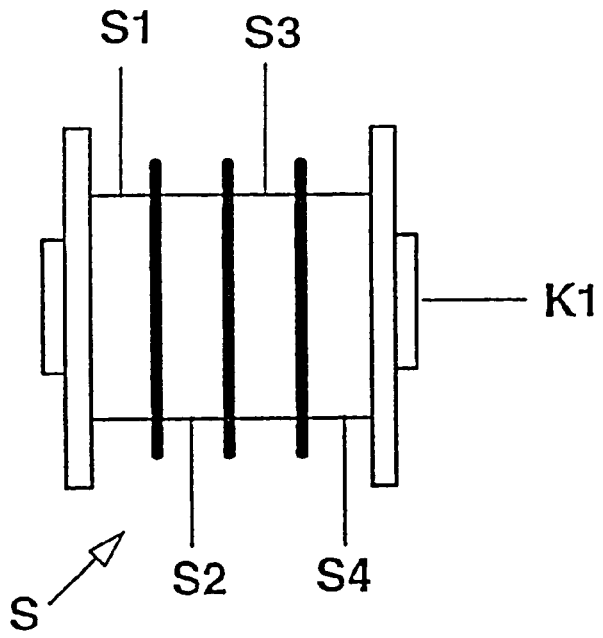
Figure 4:
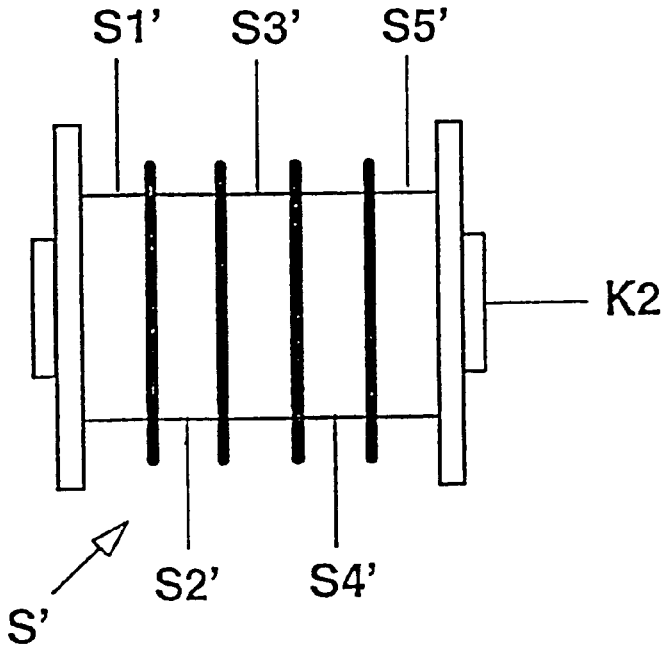
Figure 5:
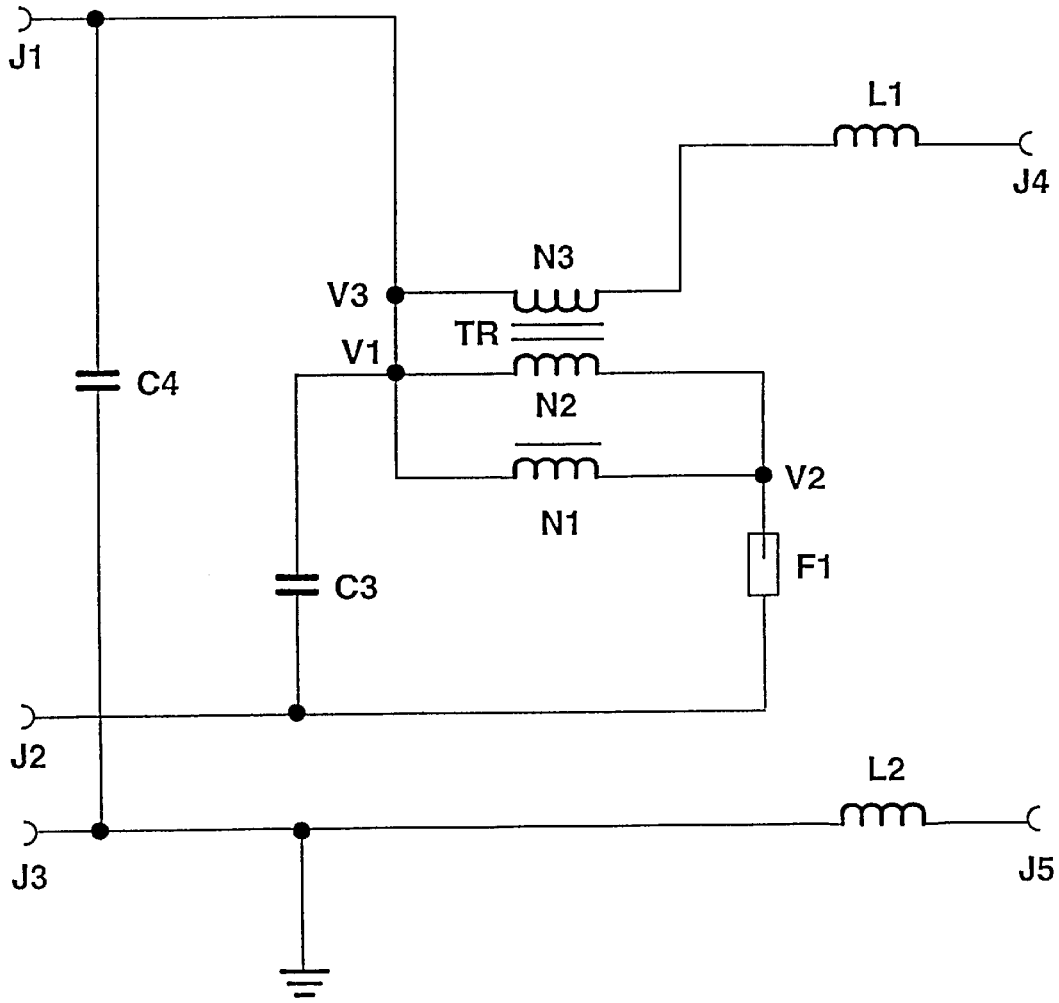

The invention is explained in more detail below with the aid of a plurality of preferred exemplary embodiments. In the drawing:

FIG. 1 shows a diagrammatic sketch of the circuit of an asymmetric starting device in accordance with the first exemplary embodiment of the invention, FIG. 2 shows a diagrammatic sketch of the circuit of a symmetrical starting device in accordance with the second exemplary embodiment of the invention, FIG. 3 shows a diagrammatic representation of the transformer of the starting device according to the invention with a 4-chamber coil former and ferrite core, FIG. 4 shows a diagrammatic representation of the transformer of the starting device according to the invention with a 5-chamber coil former and ferrite core, and FIG. 5 shows a diagrammatic sketch of the circuit of an asymmetrical starting device in accordance with the fourth exemplary embodiment of the invention.

The circuit diagram of an asymmetrical pulse starting device in accordance with the first exemplary embodiment of the invention is illustrated in FIG. 1. This starting device serves to start a gas discharge in a halogen metal vapour high-pressure discharge lamp LP1, which has an electric nominal power of 35 watts and is operated, for example, in a motor vehicle headlamp. The starting device comprises a transformer TR1 with two primary windings N10, N11 and a secondary winding N12, a capacitor C1, a resistor element R1, a spark gap F1 and a diode D1. Moreover, the starting device has a DC voltage input with a first j10 and a second DC voltage terminal j11, as well as a starting voltage output with a first j12 and a second starting voltage terminal j13.

At the DC voltage input, the starting device is provided with a DC voltage of approximately 400 V which is generated, for example, by a voltage transformer (not illustrated) from the network voltage of the motor vehicle. The DC voltage terminal j10 is at +400 V, and the other DC voltage terminal is at frame potential. The positive terminal j10 is connected via a branch point V10 to one terminal of the capacitor C1. The other terminal of the capacitor C1 is connected via a further branch point V11 and via the ohmic resistor R1 as well as via the diode D1, poled in the forward direction, to the DC voltage terminal j11, which is at frame potential. As a result, a charging current for the capacitor C1 flows via the resistor element R1 and the diode D1, the capacitor C1 thereby being charged to approximately 350 V. The branch point V10 is connected to the start of the secondary winding N12 of the transformer TR1 and to the starts of the primary windings N10, N11, arranged in a parallel circuit, of the transformer TR1. The end of the secondary winding N12 is connected to the starting voltage terminal j12 of the starting voltage output which, for its part, is connected to a gas discharge electrode E10 of the lamp LP1 when the lamp LP1 is installed. The other starting voltage terminal j13, which makes contact with the second gas discharge electrode E11 of the lamp when the lamp is installed, is connected to the DC voltage terminal j11, which is at frame potential, of the DC voltage input of the starting device.

The two primary windings N10, N11 of the transformer TR1 are connected in parallel. This means that the start of the first primary winding N10 is connected to the start of the second primary winding N11, and the end of the first primary winding N10 is connected to the end of the second primary winding N11. The starts of the transformer windings N10, N11, N12 are marked in FIG. 1 in each case by a point above the corresponding winding. The start of the two primary windings N10, N11, which are connected in parallel, is connected to the branch point V10, while the end of the two primary windings N10, N11 is connected to one terminal of the spark gap F1. The other terminal of the spark gap F1 is connected to the second branch point V11.

The transformer TR1 has a coil former S with four chambers S1, S2, S3, S4 and a cylindrical ferrite core K1, which is arranged in an axially extending cutout in the coil former S. The secondary winding N12 has 320 turns and consists of a copper litz wire with a diameter of 0.3 mm. It is wound uniformly over the four chambers S1 to S4 of the coil former S. The two primary windings N10, N11 each have two turns and consist in each case of a twenty-strand copper litz wire, each strand of the copper litz wire having a diameter of 0.1 mm. The two primary windings N10, N11 are wound, separated by an electric insulation, over the secondary winding N12. The ferrite core K1 is arranged approximately in the winding axis of the transformer windings N10, N11, N12. The ferrite core has an electric resistance of more than 1 MΩ.

At the beginning of the starting phase, the capacitor C1 is charged via the resistor R1 and via the diode D1 poled in the forward direction. Once the voltage drop across the capacitor C1 reaches a value of approximately 350 V, the spark gap F1 breaks down, that is to say corona discharges occur at the spark gap, with the result that the capacitor C1 is discharged abruptly via the parallel circuit of the two primary windings N10, N11 and via the spark gap F1. This discharging current flowing via the two primary windings N10, N11 induces in the secondary winding N12, which is coupled inductively to the two primary windings, high-voltage pulses of positive polarity which are applied to the gas discharge electrode E10, connected to the end of the secondary winding N12, of the discharge lamp LP1, and which start the gas discharge in the lamp LP1. The voltage pulses at the starting voltage output j12 and at the lamp electrode E10 reach values of up to +25 kV and have a width of approximately 300 ns. The other lamp electrode E11 is at frame potential.

The circuit diagram of a symmetrical pulse starting device in accordance with the particularly preferred second exemplary embodiment of the invention is illustrated in FIG. 2. This starting device likewise serves to start a gas discharge in a halogen metal vapour high-pressure discharge lamp LP2, which has an electric nominal power of 35 watts and is operated, for example, in a motor vehicle headlamp. The starting device comprises a transformer TR2 with two primary windings N20, N21 and two secondary windings N22, N23, a capacitor C2, a resistor element R2, a spark gap F2 and a diode D2. Moreover, the starting device has a DC voltage input with a first j20 and a second DC voltage terminal j21 as well as a starting voltage output with a first j22 and a second starting voltage terminal j23.

At the DC voltage input, the starting device is provided with a DC voltage of approximately 400 V which is generated, for example, by a voltage transformer (not illustrated) from the network voltage of the motor vehicle. The DC voltage terminal j20 is at +400 V, and the other DC voltage terminal j21 is at frame potential. The positive terminal j20 is connected via a branch point V20 to one terminal of the capacitor C2. The other terminal of the capacitor C2 is connected via a further branch point V21 and via the ohmic resistor R2 as well as via the diode D2, poled in the forward direction, to the DC voltage terminal j21, which is at frame potential. As a result, a charging current for the capacitor C2 flows via the resistor element R2 and the diode D2, the capacitor C2 thereby being charged to approximately 350 V. The branch point V20 is connected to the start of the first secondary winding N22 of the transformer TR2 and to the starts of the primary windings N20, N21, arranged in a parallel circuit, of the transformer TR2. The end of the first secondary winding N22 is connected to the starting voltage terminal j22 of the starting voltage output which, for its part, is connected to a gas discharge electrode E20 of the lamp LP2 when the lamp LP2 is installed. The other starting voltage terminal j23, which makes contact with the second gas discharge electrode E21 of the lamp LP2 when the lamp is installed, is connected to the start of the second secondary winding N23. The end of the second secondary winding N23 is connected to the DC voltage terminal j21, which is at frame potential, of the DC voltage input of the starting device.

The two primary windings N20, N21 of the transformer TR2 are connected in parallel. This means that the start of the first primary winding N20 is connected to the start of the second primary winding N21, and the end of the first primary winding N20 is connected to the end of the second primary winding N21. The starts of the transformer windings N20, N21, N22, N23 are marked in FIG. 2 in each case by a point above the corresponding winding. The start of the two primary windings N20, N21, which are connected in parallel, is connected to the branch point V20, while the end of the two primary windings N20, N21 is connected to one terminal of the spark gap F2. The other terminal of the spark gap F2 is connected to the second branch point V21. The two secondary windings N22, N23 are coupled inductively to the parallel circuit of the primary windings N20, N21 in such a way that induced voltages of opposite polarity are generated in them.

The transformer TR2 of the starting device has a coil former S' with five chambers S1', S2', S3', S4', S5' and a cylindrical ferrite core K2, which is arranged in an axially extending cutout in the coil former S'. The two primary windings N20, N21 of the transformer TR2 in each case have two turns and each consist of a twenty-strand copper litz wire, each strand of the copper litz wire having a diameter of 0.1 mm. The two secondary windings N22, N23 of the transformer TR2 have 160 turns in each case and each consist of a copper litz wire with a diameter of approximately 0.3 mm. The two primary windings N20, N21 are arranged in the middle chamber S3' of the coil former S', while the first secondary winding N22 is wound uniformly over the first two chambers S1', S2', and the second secondary winding N23 is wound over the last two chambers S4', S5' of the coil former S'. The two secondary windings N22, N23 are wound in the opposite senses. The ferrite core K2 is arranged approximately on the winding axis of the transformer windings N20, N21, N22, N23. The ferrite body K2 has an electric resistance of more than 1 MΩ.

At the beginning of the starting phase, the capacitor C2 is charged via the resistor R2 and via the diode D2 which is poled in the forward direction. Once the voltage drop across the capacitor C2 reaches a value of approximately 350 V, the spark gap F2 breaks down, that is to say corona discharges occur at the spark gap, with the result that the capacitor C2 is discharged abruptly via the parallel circuit of the two primary windings N20, N21 and via the spark gap F2. This discharging current flowing via the two primary windings N20, N21 induces unipolar high-voltage pulses in the two secondary windings N22 and N23, which are both coupled inductively to the two primary windings N20, N21. Since the two secondary windings N22, N23 have an opposite winding sense, the high-voltage pulses induced in them have an opposite polarity, with the result that positive high-voltage pulses are applied to the first lamp electrode E20 by the first secondary winding N22 via the terminal j22, and negative high-voltage pulses are simultaneously applied to the second lamp electrode E21 by the second secondary winding N23 via the terminal j23. The positive voltage pulses at the starting voltage output j22 and at the lamp electrode E20 reach values of up to +11 kV, while the negative voltage pulses at the starting voltage output j23 and at the lamp electrode E21 assume values of up to −11 kV, so that the voltage drop across the discharge path of the lamp LP2 is up to 22 kV during the starting phase.

The following table contains data on the dimensioning of the subassemblies of the two exemplary embodiments of the invention described in more detail above.

Table: Dimensioning of the subassemblies used in the exemplary embodiments according to FIGS. 1 and 2

| | |
|---|---|
| C1, C2 | 330 nF, 400 V |
| R1, R2 | 4.7 kΩ, 1 W |
| D1, D2 | UF 4007 |
| F1, F2 | KAS 03 |

The third exemplary embodiment of the invention is largely identical to the above-described first exemplary embodiment. It differs from the first exemplary embodiment only by the transformer. Like the transformer of the first exemplary embodiment illustrated in FIG. 3, the transformer of the third exemplary embodiment has a coil former with four chambers and a cylindrical ferrite core which is arranged in an axially extending cutout in the coil former. The secondary winding has 320 turns and consists of a copper litz wire with a diameter of 0.3 mm. It is wound uniformly over the four chambers of the coil former. By contrast with the first exemplary embodiment, the transformer in accordance with the third exemplary embodiment has, however, only one primary winding. This primary winding has two turns and consists of a wide copper strip which, separated by an electrically insulating varnish layer, is wound uniformly over the secondary winding, with the result that it encloses the secondary winding. The ferrite core of the transformer is arranged approximately on the winding axis of the primary and secondary windings. The ferrite body has an electric resistance of more than 1 MΩ. The third exemplary embodiment corresponds to the first in all other details.

The starting device (FIG. 5) in accordance with the fourth exemplary embodiment has a transformer TR with two primary windings N1, N2 connected in parallel and a secondary winding N3 inductively coupled to both primary windings, an automatic switch constructed as spark gap F1, a starting capacitor C3, a further capacitor C4, two inductors L1, L2, a DC voltage input J1, J2, J3, and a starting voltage output J4, J5. The starting capacitor C3 and the spark gap F1 are secured to a metal plate formed as ring segment with which they form a prefabricated unit. To secure the starting capacitor C3 and the spark gap F1 to the metal plate, in each case one electric terminal of the starting capacitor C3 and of the spark gap F1 is connected to the metal plate by one or a plurality of weld points. To this unit there further belong two sheet strips and, welded to the metal plate, a wire which serves as electric terminal for the metal plate. The first sheet strip is connected to the second electric terminal of the starting capacitor C3 by one or a plurality of weld points. The second sheet strip is connected to the second electric terminal of the spark gap F1 by one or a plurality of weld points. In each case one free end of the first and of the second sheet strip is provided with an electric terminal which serves for electrically connecting the start of the winding and the end of the winding, respectively, of the primary windings N1, N2 to the second terminal of the starting capacitor C3 and to the second terminal of the spark gap F1, respectively.

The starting device illustrated in FIG. 5 has three DC voltage terminals J1 (for −400V supply voltage), J2 (for +600V supply voltage), J3 (is connected to earth or to frame potential) of which optionally two are used. The DC voltage terminal J1 is connected via the branch points V3, V1 to the second terminal of the starting capacitor C3. The first terminal of the starting capacitor C3 (68 nF; 1000V) is connected to the DC voltage terminal J2 and by the metal plate to the first terminal of the spark gap F1. The branch point V3 is connected via the secondary winding N3 of the transformer TR and the downstream inductor L1 to the starting voltage ouptut J4. The branch point V1 is connected to the start of the two primary windings N1, N2 connected in parallel. The ends of the two primary windings N1, N2 are connected via the branch point V2 to the second terminal of the spark gap F1. The DC voltage terminal J3 is connected to the DC voltage output J5 via the inductor L2. The starting device has in addition a further capacitor C4 (4.7nF; 1000V) whose first terminal is connected to the DC voltage terminal J1 and whose second terminal is connected to the DC voltage terminal J3.

The invention is not restricted to the exemplary embodiments explained above in more detail. For example, in all the exemplary embodiments explained above, it is also possible to use an E core or a ring core or a U-core for the transformer instead of a cylindrical ferrite core. Moreover, it is also possible to replace the spark gap by an equivalent automatic switch, for example a semiconductor switch. The diode D1 or D2 serves to protect the capacitor C1 or C2 in the case where the DC voltage terminals of the DC voltage input of the starting device are exchanged with one another. It is not mandatory for the serviceability of the starting device according to the invention. The transformer TR of the starting device in accordance with the fourth exemplary embodiment can in addition have a further second secondary winding which is connected between the terminals j3 and j5 in series with inductor L2, with the result that the asymmetrical starting device of the fourth exemplary embodiment becomes a symmetrical starting device which applies starting voltage pulses to both lamp electrodes.

What is claimed is:

1. Starting device for a discharge lamp (LP1; LP2), having a DC voltage input (j10, j11; j20, j21; j1, j2, j3) with a first (j10; j20; j1) and a second DC voltage terminal (j11; j21; j3), a starting voltage output with two starting voltage terminals (j12, j13; j22, j23; j4; j5) for the discharge lamp (LP1; LP2), a capacitor (C1; C2; C3) having two terminals, an automatic switch (F1; F2), a transformer (TR1; TR2; TR) with at least one primary winding (N10; N20; N1) and at least one secondary winding (N12; N22; N3), which in each case have a start of the winding and an end of the winding, characterized in that the transformer (TR1; TR2; TR) has a parallel circuit of at least two primary windings (N10, N11; N20, N21; N1, N2) which is inductively coupled to the at least one secondary winding (N12; N22; N3).

2. Starting device according to claim 1, characterized in that the starts of the winding of all the primary windings (N10, N11; N20; N21; N1, N2) are interconnected, and the ends of the winding of all the primary windings (N10, N11; N20, N21; N1, N2) are interconnected.

3. Starting device according to claim 1, characterized in that the transformer (TR1; TR) has one secondary winding (N12; N3) whose start of the winding or end of the winding is connected to one of the starting voltage terminals (j12; j4) for the discharge lamp (LP1).

4. Starting device according to claim 1, characterized in that the primary windings (N10, N11; N20, N21; N1, N2) in each case have at most two turns.

5. Starting device according to claim 1, characterized in that the DC voltage input (j1, j2,j3) of the starting device has in addition a third DC voltage terminal (j2) to adapt the starting device to different supply voltages.

6. Starting device according to claim 1, characterized in that the first DC voltage terminal (j10) is connected to a first terminal of the capacitor (C1), the second terminal of the capacitor (C1) is connected via a resistor element (R1) with the second DC voltage terminal (j11), the first terminal of the capacitor (C1) is connected via the parallel circuit of the primary windings (N10, N11), and via the switching path of the automatic switch (F1) to the second terminal of the capacitor (C1), the start or the end of the at least one secondary winding (N12) is connected to the first terminal of the capacitor (C1), and the end or the start of the at least one secondary winding (N12) is connected to the first starting voltage terminal (j12), and the second DC voltage terminal (j11) is connected to the second starting voltage terminal (j13).

7. Starting device according to claim 1, characterized in that the automatic switch (F1; F2) is a spark gap or a semiconductor switch.

8. Starting device according to claim 1, characterized in that the transformer (TR2) has at least two secondary windings (N22, N23), at least one first (N22) of the at least two secondary windings (N22, N23) being connected to the first starting voltage terminal (j22), at least one second (N23) of the at least two secondary windings (N22, N23) being connected to the second starting voltage terminal (j23), and the at least one first (N22) and the at least one second secondary winding (N23) being arranged in such a way that induced voltages of opposite polarity are generated in said secondary windings (N22, N23).

9. Starting device according to claim 8, characterized in that the at least one first (N22) and the at least one second secondary winding (N23) of the transformer (TR2) have an opposite winding sense.

10. Starting device according to claim 8, characterized in that the first DC voltage terminal (j20) is connected to a first terminal of the capacitor (C2), the second terminal of the capacitor (C2) is connected via a resistor element (R2) to the second DC voltage terminal (j21), the first terminal of the capacitor (C2) is connected via the parallel circuit of the primary windings (N20, N21) and via the switching path of the automatic switch (F2) to the second terminal of the capacitor (C2), the start or the end of the at least one first secondary winding (N22) is connected to the first terminal of the capacitor (C2), and the end or the start of the at least one first secondary winding (N22) is connected to the first starting voltage terminal (j22), and the end or the start of the at least one second secondary winding (N23) is connected to the second DC voltage terminal (j21), and the start or the end of the at least one second secondary winding (N23) is connected to the second starting voltage terminal (j23).

11. Starting device according to claim 1, characterized in that the transformer has a ferrite body (K1; K2) and a coil former (S; S') with at least one chamber for the transformer windings.

12. Starting device according to claim 1, characterized in that each of the primary windings is constructed as a copper strip which is wound in an electrically insulated fashion over the at least one secondary winding of the transformer.

13. Starting device for a discharge lamp, having a DC voltage input with a first and a second DC voltage terminal, a starting voltage output with two starting voltage terminals for the discharge lamp, a capacitor with two terminals, an automatic switch, and a transformer with a primary winding and at least one secondary winding, which in each case have a start of the winding and an end of the winding, characterized in that the primary winding has at most two turns and consists of a metal strip which encloses the at least one secondary winding.

14. Starting device according to claim 13, characterized in that the transformer has a ferrite body and a coil former with at least one chamber for the at least one secondary winding of the transformer, the at least one primary winding enclosing the ferrite body and the at least one secondary winding.

15. Starting device according to claim 11, characterized in that the ferrite body (K1; K2) is a cylinder core, a tubular core, a threaded core or an E core.

16. Starting device according to claim 11, characterized in that the ferrite body (K1, K2) is a ring core or a U-core.

17. Starting device according to claim 11, characterized in that the ferrite body (K1; K2) has an electric resistance of more than 1 MΩ.

18. Method for starting a discharge lamp comprising the steps of:

providing a starting device having a DC voltage input and a second DC voltage terminal, a starting voltage output with two starting voltage terminals for the discharge lamp, a capacitor having two terminals, an automatic switch, a transformer with at least one primary winding, which in each case have a start of the winding and an end of the winding, the transformer having a parallel circuit of a least two primary windings which are inductively coupled to the at least one secondary winding; and applying to the electrode connected to the first starting voltage terminal of the discharge lamp voltage pulses which are induced in the at least one secondary winding by the discharging current of the capacitor flowing via the parallel circuit of the least two primary windings and via the switching path of the automatic switch.

19. The method according to claim 18 further comprising the steps of providing the transformer with at least two secondary windings, and applying to the electrodes connected to the two starting voltage terminals of the discharge lamp voltage pulses of opposite polarity which are induced in the at least two secondary windings by the discharging of current of the capacitor flowing via the parallel circuit of the at least two primary windings and via the switching path of the automatic switch.

20. The method according to claim 19 further comprising the step of simultaneously applying unipolar voltage pulses of opposite polarity to the electrodes connected to the two starting voltage terminals of the discharge lamp.

* * * * *